US011156138B2

(12) United States Patent
Miyashita

(10) Patent No.: US 11,156,138 B2
(45) Date of Patent: Oct. 26, 2021

(54) OUTBOARD MOTOR

(71) Applicant: SUZUKI MOTOR CORPORATION, Hamamatsu (JP)

(72) Inventor: Yasushi Miyashita, Hamamatsu (JP)

(73) Assignee: SUZUKI MOTOR CORPORATION, Shizuoka (JP)

( * ) Notice: Subject to any disclaimer, the term of this patent is extended or adjusted under 35 U.S.C. 154(b) by 46 days.

(21) Appl. No.: 16/719,132

(22) Filed: Dec. 18, 2019

(65) Prior Publication Data

US 2020/0248602 A1 Aug. 6, 2020

(30) Foreign Application Priority Data

Jan. 31, 2019 (JP) ..... JP2019-015089

(51) Int. Cl.

| | |
|---|---|
| ***F01N 3/04*** | (2006.01) |
| ***B63H 20/28*** | (2006.01) |
| ***B63H 20/24*** | (2006.01) |
| ***F02B 75/22*** | (2006.01) |
| ***F01N 3/28*** | (2006.01) |
| ***F02M 37/00*** | (2006.01) |
| ***F02B 63/04*** | (2006.01) |
| ***F02M 35/116*** | (2006.01) |
| ***F02B 61/04*** | (2006.01) |

(52) U.S. Cl.

CPC ..... *F01N 3/04* (2013.01); *B63H 20/24* (2013.01); *B63H 20/28* (2013.01); *F01N 3/2882* (2013.01); *F02B 61/045* (2013.01); *F02B 63/042* (2013.01); *F02B 75/22* (2013.01); *F02M 35/116* (2013.01); *F02M 37/0047* (2013.01); *F01N 2260/024* (2013.01)

(58) Field of Classification Search

CPC .... F01N 3/04; F01N 3/2882; F01N 2260/024; B63H 20/24; B63H 20/28; F02B 61/045; F02B 63/042; F02B 75/22; F02M 35/116; F02M 37/0047

See application file for complete search history.

(56) References Cited

U.S. PATENT DOCUMENTS

| | | | | |
|---|---|---|---|---|
| 5,494,467 | A * | 2/1996 | Sohgawa | F01N 13/12 440/89 R |
| 8,690,625 | B2 | 4/2014 | Kato et al. | |
| 8,858,283 | B2 * | 10/2014 | Ochiai | F01N 13/10 440/89 R |
| 9,174,818 | B1 * | 11/2015 | Langenfeld | B63H 20/245 |
| 2002/0127929 | A1 * | 9/2002 | Wada | F02M 35/167 440/88 A |
| 2013/0157533 | A1 | 6/2013 | Kato et al. | |

FOREIGN PATENT DOCUMENTS

| | | |
|---|---|---|
| JP | 2013124594 A | 6/2013 |

* cited by examiner

*Primary Examiner* — Stephen P Avila
(74) *Attorney, Agent, or Firm* — Holtz, Holtz & Volek PC

(57) ABSTRACT

An outboard motor (10) includes a V-engine (20) having a left bank (BL) and a right bank (BR) extending obliquely toward a rear left side and a rear right side, respectively, relative to a crankshaft (21) extending in a vertical direction. An intake device (18) is provided between the left bank and the right bank, and catalyst devices (62L, 62R) that treat exhaust gas are disposed rearward of cylinder heads (24L, 24R) of the left bank and the right bank.

9 Claims, 8 Drawing Sheets

OUTBOARD MOTOR

BACKGROUND OF THE INVENTION

Field of the Invention

The present invention relates to an outboard motor including a catalyst device.

Description of the Related Art

To prevent air and water pollution, some outboard motors are equipped with a catalyst device that treats exhaust gas from the engine. Japanese Patent Application Laid-Open Publication No. 2013-124594 (Patent Literature 1) describes a technique relating to an outboard motor including a four-stroke V-engine with a pair of left and right cylinder blocks disposed in a V-shape as seen in a plan view. In this outboard motor, left and right exhaust passages making a pair are provided outward of a crankcase and the cylinder blocks (V-bank) in the width direction of the outboard motor, and catalysts are disposed inside these left and right exhaust passages.

The arrangement of the exhaust passages and the catalysts in the outboard motor of the Patent Literature 1 requires bending each exhaust passage into a U-shape at a steep angle from a cylinder head toward the catalyst device. The problem is that this arrangement creates a high exhaust resistance, which is likely to cause a decrease in the engine output.

Large-sized outboard motors are often used in the form of so-called multi-unit hanging in which a plurality of outboard motors is mounted on a hull in parallel to one another. To avoid interference between outboard motors that are disposed next to each other (i.e., to allow a large number of outboard motors to be installed in a limited space without interference), it is desired to reduce the width of each outboard motor as much as possible. In the outboard motor of Patent Literature 1, since the left and right catalyst devices having large volumes are provided outward of the crankcase and the cylinder blocks in the width direction of the outboard motor, the width of the outboard motor is largest at the positions of the left and right catalyst devices. These catalyst devices are located close to a central part of the outboard motor in the long-side direction (front-rear direction), and thus add to the width of the outboard motor that matters when adopting multi-unit hanging.

SUMMARY OF THE INVENTION

The present invention has been devised in view of the above described problems and provides an outboard motor that includes a built-in catalyst device and yet has excellent exhaust efficiency and a compact configuration.

According to an aspect of the present invention, an outboard motor is provided, including a V-engine having a left bank and a right bank extending obliquely toward a rear left side and a rear right side, respectively, relative to a crankshaft extending in a vertical direction. An intake device is provided between the left bank and the right bank, and catalyst devices that treat exhaust gas are disposed rearward of a cylinder head of each of the left bank and the right bank.

By allowing catalyst devices to be disposed with good space efficiency and an exhaust passage to be smoothly routed, the present invention can provide an outboard motor that includes built-in catalyst devices and yet has excellent exhaust efficiency and a compact configuration.

DETAILED DESCRIPTION OF THE PREFERRED EMBODIMENTS

Figure 1:
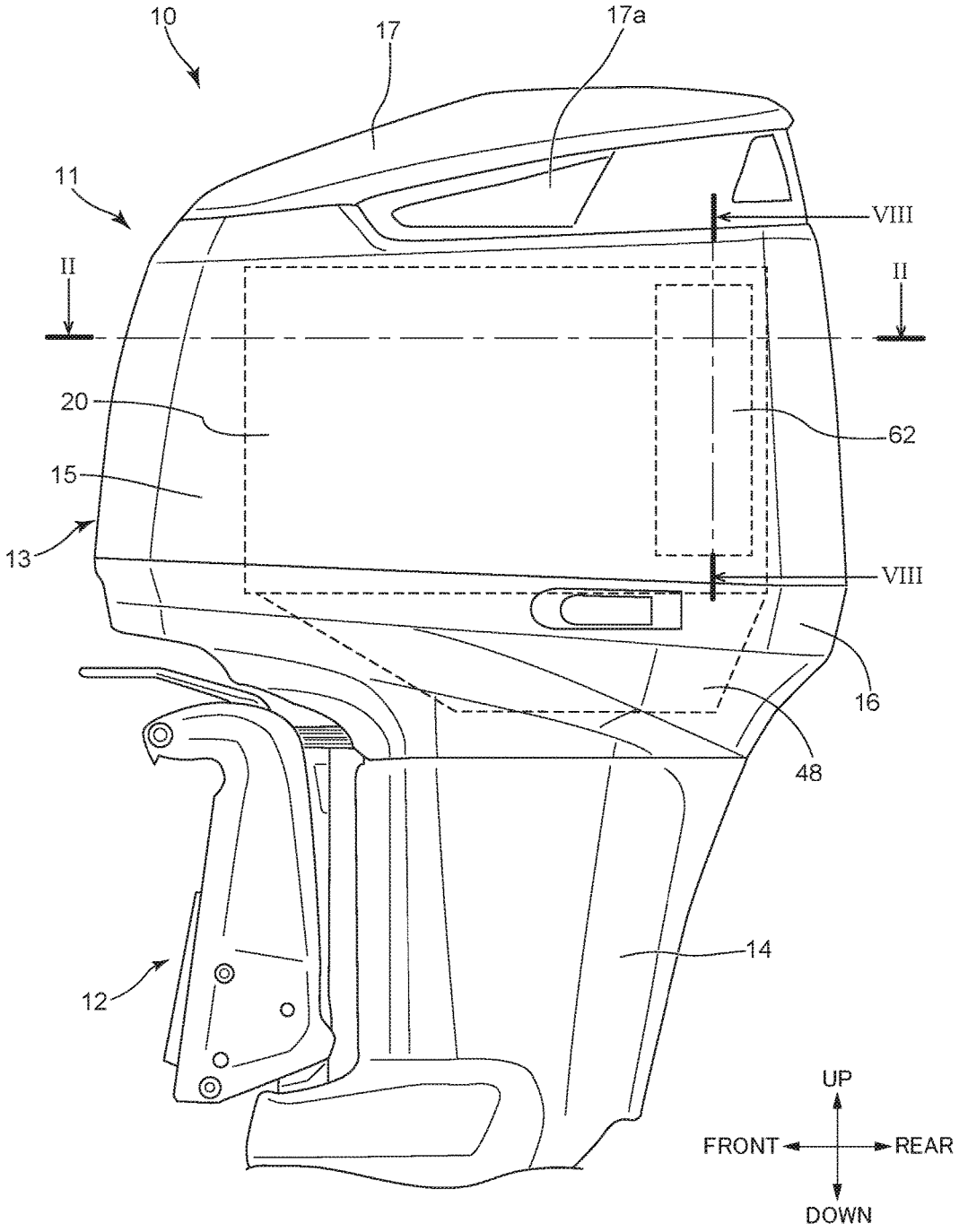
FIG. 1 is a side view of an outboard motor according to an embodiment.

An embodiment of the present invention will be described below in detail with reference to the accompanying drawings. FIG. 1 is a side view of an outboard motor 10 according to the embodiment. Directions of front, rear, left, right, up, and down of the outboard motor 10 are indicated by arrows in the drawings. The outboard motor 10 has a generally elongated shape in a front-rear direction as seen in a plan view (see FIG. 2), and the front-rear direction, a left-right direction, and an up-down direction correspond to a long-side direction, a width direction, and a height direction, respectively, of the outboard motor 10. The outboard motor 10 is mounted on a stern (not shown) of a hull. While the direction of the outboard motor 10 can be changed relative to the hull, the directions indicated by the arrows in the drawings are those in an initial state in which a crankshaft 21 (FIG. 2), to be described later, extends in a vertical direction.

As shown in FIG. 1, the outboard motor 10 has an outboard motor main body 11, and a bracket device 12 that is used to mount the outboard motor main body 11 onto the stern of the hull. The outboard motor main body 11 has an engine cover 13 that is an outer covering member provided at an upper part, and a mid-section 14 provided under the engine cover 13. A propeller (not shown) is provided in the vicinity of a lower end of the mid-section 14. The engine cover 13 is composed of an upper cover 15, a lower cover 16, and a top cover 17. The bracket device 12 is disposed on the front side of the lower cover 16 and the mid-section 14.

The upper cover 15 has a shape that opens toward the upper side and the lower side. As the lower cover 16 is joined to the lower side of the upper cover 15 and the upper side of the upper cover 15 is covered with the top cover 17, an engine compartment 13*a* (FIG. 2) is formed inside the outboard motor main body 11. A V-engine (hereinafter referred to simply as an engine) 20, to be described later, is housed in the engine compartment 13*a*. Joint interfaces formed by joining the lower cover 16 and the top cover 17 to the upper cover 15 are sealed with a seal member (not shown), so that water, such as seawater, is prevented from entering the engine compartment 13*a* through these joint interfaces. The top cover 17 has an outside air intake opening 17*a* through which combustion air for the engine 20 is taken in.

Figure 2:
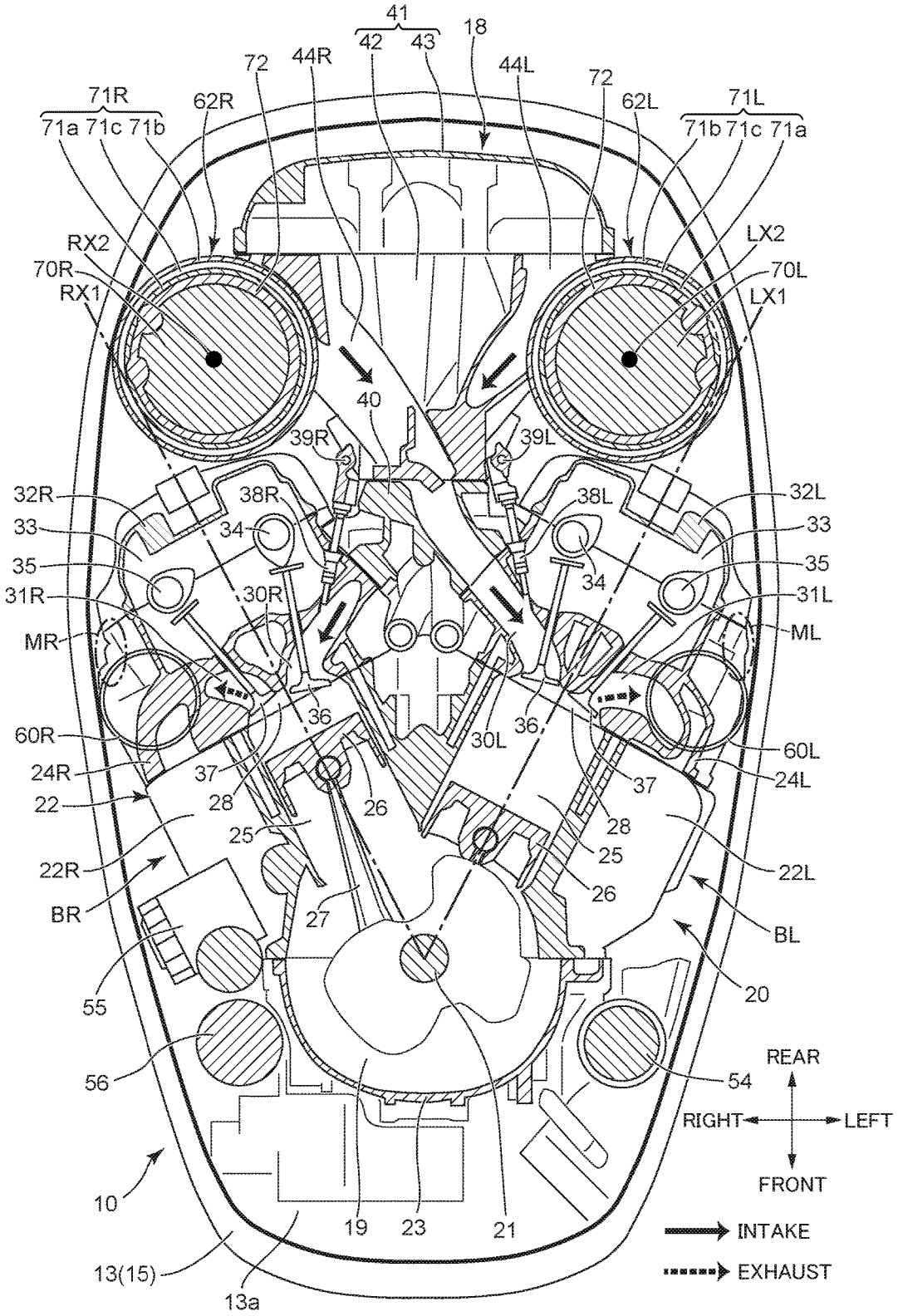
FIG. 2 is a sectional view taken along line II-II of FIG. 1.

The crankshaft 21 extending in the vertical direction is disposed inside the engine compartment 13*a*, closer to the front side (see FIG. 2). A power conversion mechanism (not shown) is provided at a lower end of the crankshaft 21. The outboard motor 10 converts driving force of the engine 20 into rotational force of the propeller (not shown) through the crankshaft 21 and the power conversion mechanism to thereby obtain propulsion.

The internal structure of the outboard motor 10 disposed inside the engine compartment 13*a* will be described with reference to FIG. 2 to FIG. 8. The engine 20 is housed inside the engine compartment 13*a*. The engine 20 is a V-engine having a left bank BL and a right bank BR disposed in a V-shape centered at the crankshaft 21. A cylinder block 22 having a left bank part 22L and a right bank part 22R making a left and right pair is installed in a V-shape as seen in a plan view, to form a V-shaped cylinder bank (V-bank) opening rearward. The left bank BL extends obliquely from the crankshaft 21 toward the rear left side, and the right bank BR extends obliquely from the crankshaft 21 toward the rear right side. FIG. 2 shows a bank central axis LX1 extending in an advancing-retracting direction of a piston 26, to be described later, and passing through the center of the left bank BL, and a bank central axis RX1 extending in an advancing-retracting direction of a piston 26 and passing through the center of the right bank BR. The bank central axis LX1 and the bank central axis RX1 intersect each other on a central axis of the crankshaft 21.

As shown in FIG. 2, a crankcase 23 is disposed at a foremost part (on the bow side) of the engine 20. The cylinder block 22 is disposed rearward of the crankcase 23. The crankshaft 21 is rotatably supported inside a crank chamber 19 formed between the crankcase 23 and the cylinder block 22.

Cylinder heads 24 (24L, 24R) are provided rearward of the cylinder block 22. The cylinder heads 24 (24L, 24R) include a left cylinder head 24L forming the left bank BL along with the left bank part 22L, and a right cylinder head 24R forming the right bank BR along with the right bank part 22R. The engine 20 of this embodiment is a water-cooled, four-stroke, six-cylinder V-engine, and has three cylinders 25 (see FIG. 2) formed inside each of the left bank part 22L and the right bank part 22R at different positions in the up-down direction. The cylinders 25 and the cylinder heads 24L, 24R are arranged along the bank central axes LX1, RX1. One piston 26 is slidably inserted in each cylinder 25. The pistons 26 are coupled to the crankshaft 21 through connecting rods 27, and advance and retract in directions along the bank central axes LX1, RX1 to rotate the crankshaft 21.

The cylinder heads 24L, 24R are provided with combustion chambers 28 corresponding to the respective cylinders 25, and intake ports 30 (30L, 30R) and exhaust ports 31 (31L, 31R) communicating with the combustion chambers 28. Head covers 32 (32L, 32R) are mounted on rear parts of the cylinder heads 24L, 24R. The left head cover 32L forms a rearmost part of the left bank BL, and the right head cover 32R forms a rearmost part of the right bank BR. An intake camshaft 34 and an exhaust camshaft 35 are rotatably supported inside each of valve gear chambers 33 formed between the cylinder heads 24L, 24R and the head covers 32L, 32R.

The intake ports 30 (30L, 30R) are disposed so as to open at parts on the inside of the V-shape formed by the left bank BL and the right bank BR. The intake port 30L provided in the left cylinder head 24L is provided so as to extend toward the rear right side of the engine 20. The intake port 30R provided in the right cylinder head 24R is provided so as to extend toward the rear left side of the engine 20. The intake port 30L is disposed substantially parallel to the bank central axis RX1 of the right bank BR, and the intake port 30R is disposed substantially parallel to the bank central axis LX1 of the left bank BL. Portions of the intake ports 30 (30L, 30R) that communicate with the combustion chambers 28 are opened and closed by intake valves 36. Opening and closing of each intake valve 36 is controlled by a cam provided on the intake camshaft 34.

The exhaust ports 31 (31L, 31R) are disposed so as to open at parts on the outside of the V-shape formed by the left bank BL and the right bank BR. The exhaust port 31L provided in the left cylinder head 24L is located on the rear left side of the combustion chambers 28, and the exhaust port 31R provided in the right cylinder head 24R is located on the rear right side of the combustion chambers 28. Portions of the exhaust ports 31 (31L, 31R) that communicate with the combustion chambers 28 are opened and closed by exhaust valves 37. Opening and closing of each exhaust valve 37 is controlled by a cam provided on the exhaust camshaft 35.

Fuel injectors (hereinafter referred to as injectors) 38 (38L, 38R) that inject fuel to the intake ports 30 (30L, 30R) are mounted on the cylinder heads 24 (24L, 24R). Delivery pipes 39 (39L, 39R) extending in the up-down direction are connected to the injectors 38 (38L, 38R). The injectors 38 (38L, 38R) are composed of an injector 38L mounted on the left cylinder head 24L and an injector 38R mounted on the right cylinder head 24R. A rear end of the injector 38L is connected to the delivery pipe 39L, and a rear end of the injector 38R is connected to the delivery pipe 39R. The delivery pipes 39L, 39R function as pipelines that transfer the fuel to be injected from the injectors 38L, 38R. The delivery pipes 39L, 39R are disposed on lateral sides of a joint between an intake manifold 40 and a surge tank 41, to be described later.

Figure 5:
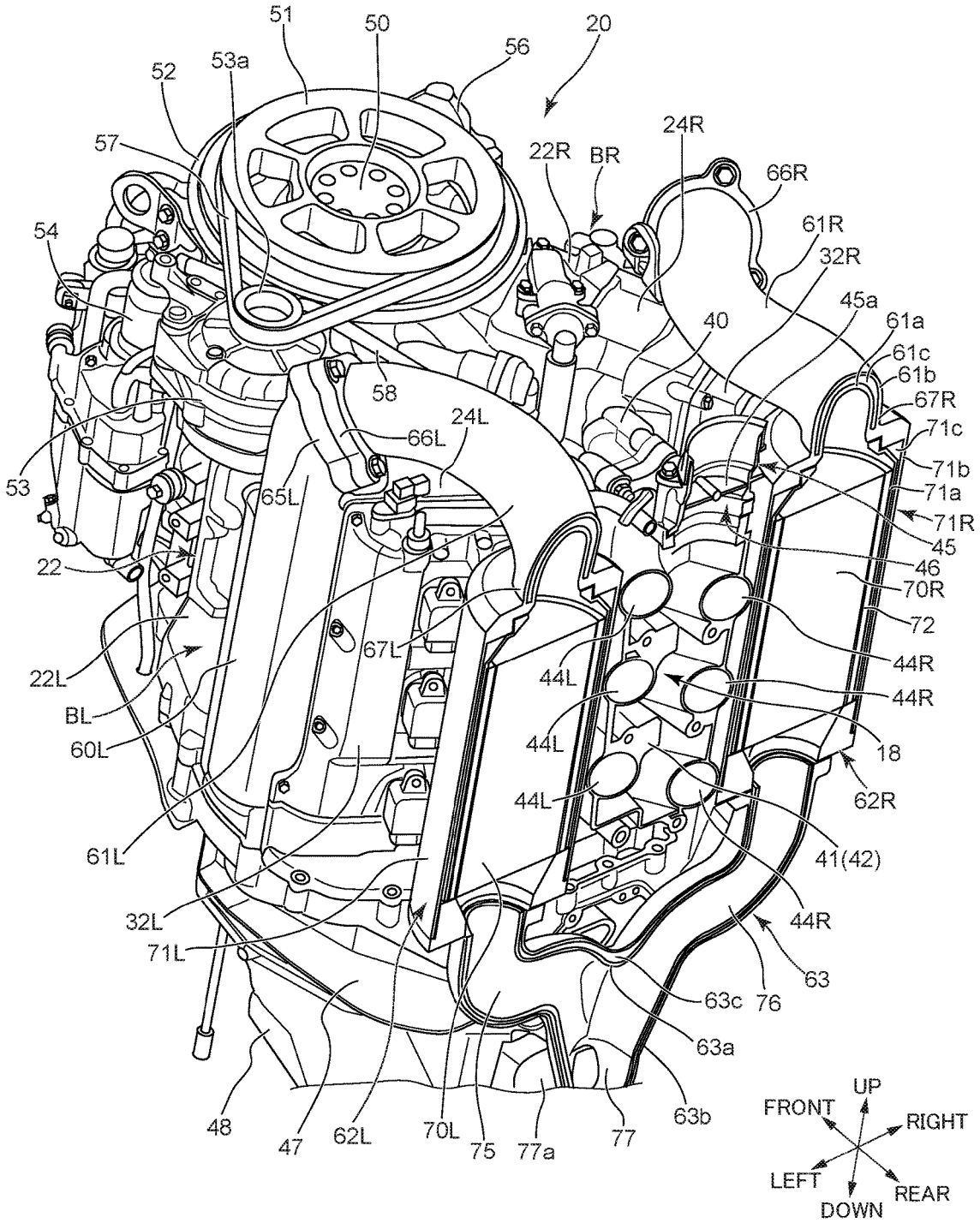
FIG. 5 is a perspective view of the internal structure of the outboard motor, which is shown partially in a sectional view.
Figure 6:
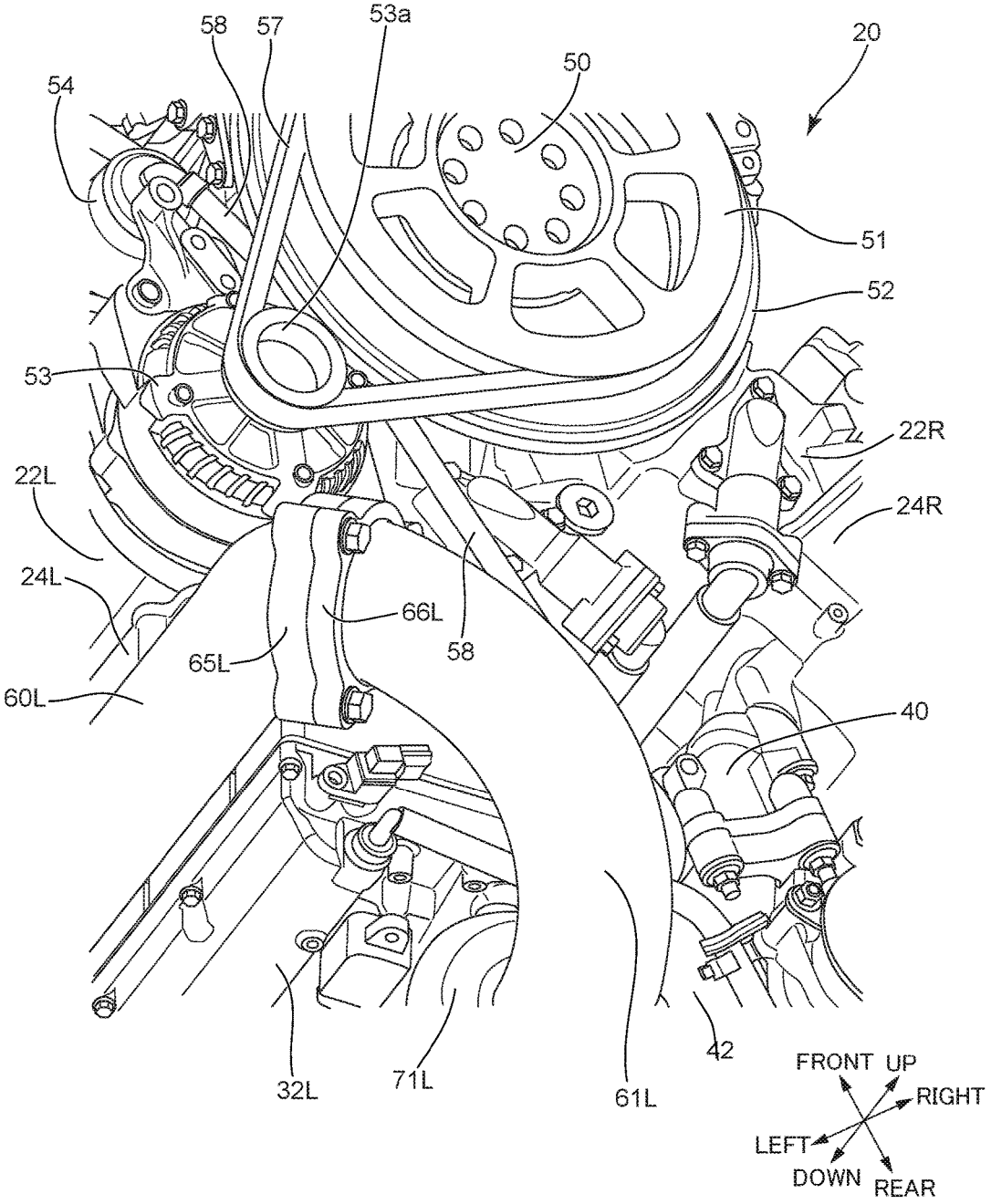
FIG. 6 is a perspective view showing a part of the internal structure of the outboard motor.

As a constituent element of an intake device 18 of the engine 20, the surge tank 41 is provided rearward of a central part of the engine 20 in the width direction, through the intake manifold 40 connected to the intake ports 30 (30L, 30R). The surge tank 41 includes a surge tank main body 42 and a lid member 43 that hermetically closes the surge tank main body 42. The surge tank main body 42 is hollow inside and open on a rear end side. As shown in FIG. 5, a plurality of (in this embodiment, six) intake pipes 44 (44L, 44R) is provided inside the surge tank 41. A rear end of each intake pipe 44 (44L, 44R) is open toward the lid member 43.

As another constituent element of the intake device 18, a throttle body 45 is provided at an upper part of the surge tank 41. The throttle body 45 takes in outside air that has been introduced into a silencer (not shown) through the outside air intake opening 17*a* of the top cover 17. The throttle body 45 has an intake passage 46 extending in the up-down direction, and a throttle valve 45*a* turnably mounted inside the intake passage 46. The flow rate of intake air flowing through the inside of the intake passage 46 is controlled as the throttle valve 45*a* turns and the degree of opening is thereby adjusted.

The outside air taken in through the intake passage 46 of the throttle body 45 enters inside the surge tank 41, flows into openings at the rear ends of the intake pipes 44 (44L, 44R) by passing through an internal space of the surge tank main body 42 and the lid member 43, and flows toward the front side. The surge tank 41 functions to temporarily collect the outside air taken in through the throttle body 45 and equalize the amount of air (combustion air) supplied to the cylinders 25. As the amount of combustion air supplied is thus equalized by the surge tank 41, an excessive inflow of combustion air to a certain cylinder 25 can be avoided.

The intake pipes 44 (44L, 44R) provided in the surge tank 41 are connected to the respective cylinders 25 through the intake manifold 40 and the intake ports 30 (30L, 30R) provided in the cylinder heads 24 (24L, 24R). The intake pipes 44 (44L, 44R) include three intake pipes 44L disposed on the left side of the engine 20 and three intake pipes 44R disposed on the right side of the engine 20 (see FIG. 5). The right intake pipes 44R are disposed coaxially with the intake port 30L inside the left bank BL, with the intake manifold 40 interposed therebetween. The left intake pipes 44L are disposed coaxially with the intake port 30R inside the right bank BR, with the intake manifold 40 interposed therebetween.

As shown in FIG. 2, a space formed inside the intake pipes 44 (44L, 44R), the intake manifold 40, and the intake ports 30 (30L, 30R) constitutes an intake passage. More specifically, a space formed inside the intake port 30L, the intake manifold 40, and the intake pipes 44R constitutes an intake passage that supplies combustion air to the combustion chambers 28 of the left cylinder head 24L. A space formed inside the intake port 30R, the intake manifold 40, and the intake pipes 44L constitutes an intake passage that supplies combustion air to the combustion chambers 28 of the right cylinder head 24R.

The pair of intake passages are disposed so as to extend substantially parallel to the bank central axes LX1, RX1 of the left bank BL and the right bank BR and intersect each other in an X-shape. The pair of injectors 38 (38L, 38R) are each disposed in a region surrounded by the intersection of these intake passages and the valve gear chamber 33 of the cylinder head 24 (24L, 24R).

When thus disposed so as to intersect in an X-shape, the pair of left and right intake passages can be each formed in a straight linear shape, which can reduce the intake resistance in the intake passages. Moreover, regions in the vicinity of the intake passages formed in a straight linear shape can be used to dispose the injectors 38L, 38R, so that interference between the injectors 38L, 38R and the intake passages can be prevented. Thus, in the configuration in which the pair of left and right cylinder heads 24L, 24R are disposed in a V-shape, the intake system and the fuel supply system can be disposed with good space efficiency, and the intake efficiency of the intake system can be increased.

Figure 7:
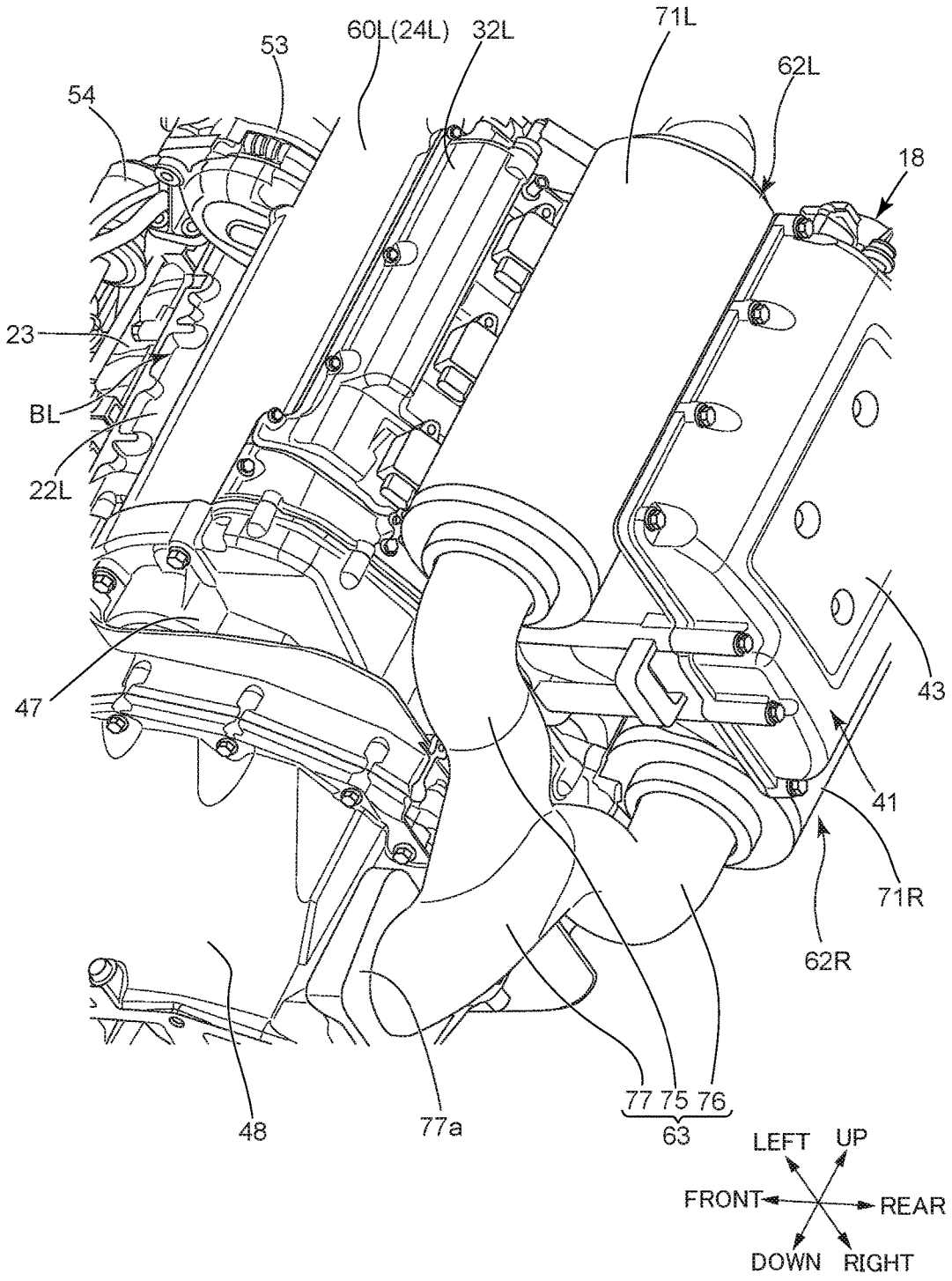
FIG. 7 is a perspective view showing a part of the internal structure of the outboard motor.

As shown in FIG. 7, an engine holder 47 and an oil pan 48 are provided at a lower part of the engine 20. The engine holder 47 supports, from below, a main body part of the engine 20 including the cylinder block 22 and the cylinder heads 24 (24L, 24R). An oil storing space is formed inside the oil pan 48. The oil stored in the oil storing space is pumped by an oil pump (not shown) and circulates through an oil flow passage (not shown) to lubricate parts of the engine 20.

As shown in FIG. 2, in the engine 20 that is a V-engine, the interval between the left and right bank central axes LX1, RX1 increases from the crankshaft 21 toward the rear side. This means that the width of the cylinder bank (V-bank) in the left-right direction is larger at rear end parts of the cylinder heads 24 (24L, 24R) far away from the crankshaft 21 than at a front end part of the cylinder block 22 (left bank part 22L and right bank part 22R) close to the crankshaft 21. More specifically, in the left bank BL, a portion of the cylinder head 24L around a rearmost end thereof connected to the head cover 32L protrudes farthest leftward in the width direction of the outboard motor 10. In the right bank BR, a portion of the cylinder head 24R around a rearmost end thereof connected to the head cover 32R protrudes farthest rightward in the width direction of the outboard motor 10. These portions that protrude farthest will be referred to as widest portions ML, MR (see FIG. 2 and FIG. 4) in the engine 20.

As shown in FIG. 2, side surfaces of the engine cover 13 (upper cover 15) are smoothly curved such that the width of the engine cover 13 in the left-right direction is largest at both sides of the widest portions ML, MR located near the center in the front-rear direction, and that the interval between both side surfaces decreases gradually from the widest portions ML, MR toward the front side and the rear side. Various parts of the fuel supply system, electrical system, lubrication system, exhaust system, etc. are disposed with good space efficiency so as to be distributed between spaces on the front side and the rear side of the cylinder heads 24L, 24R including the widest portions ML, MR, without impairing this basic outer shape of the outboard motor 10. This will be described in detail below.

Figure 3:
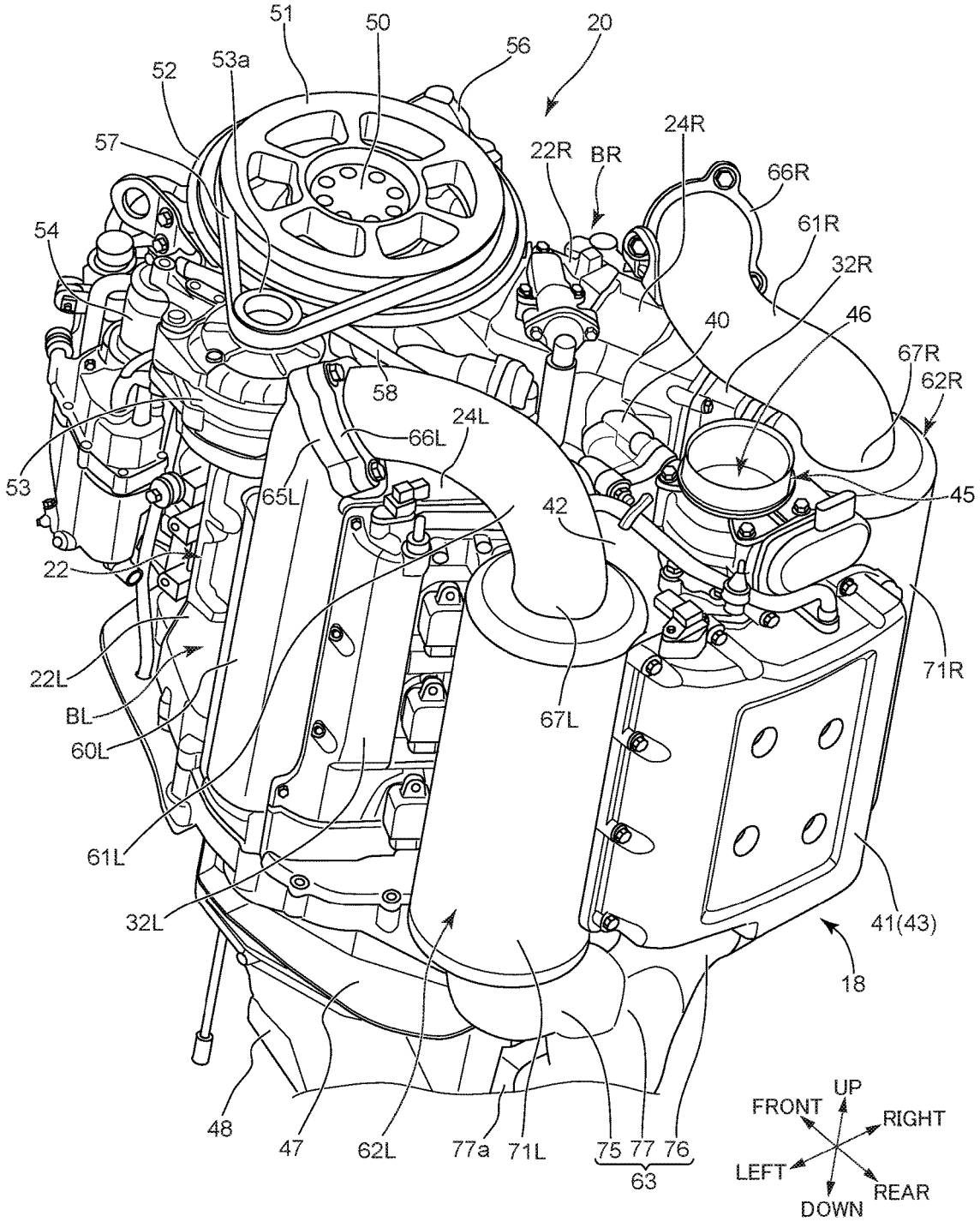
FIG. 3 is a perspective view showing the internal structure of the outboard motor.
Figure 4:
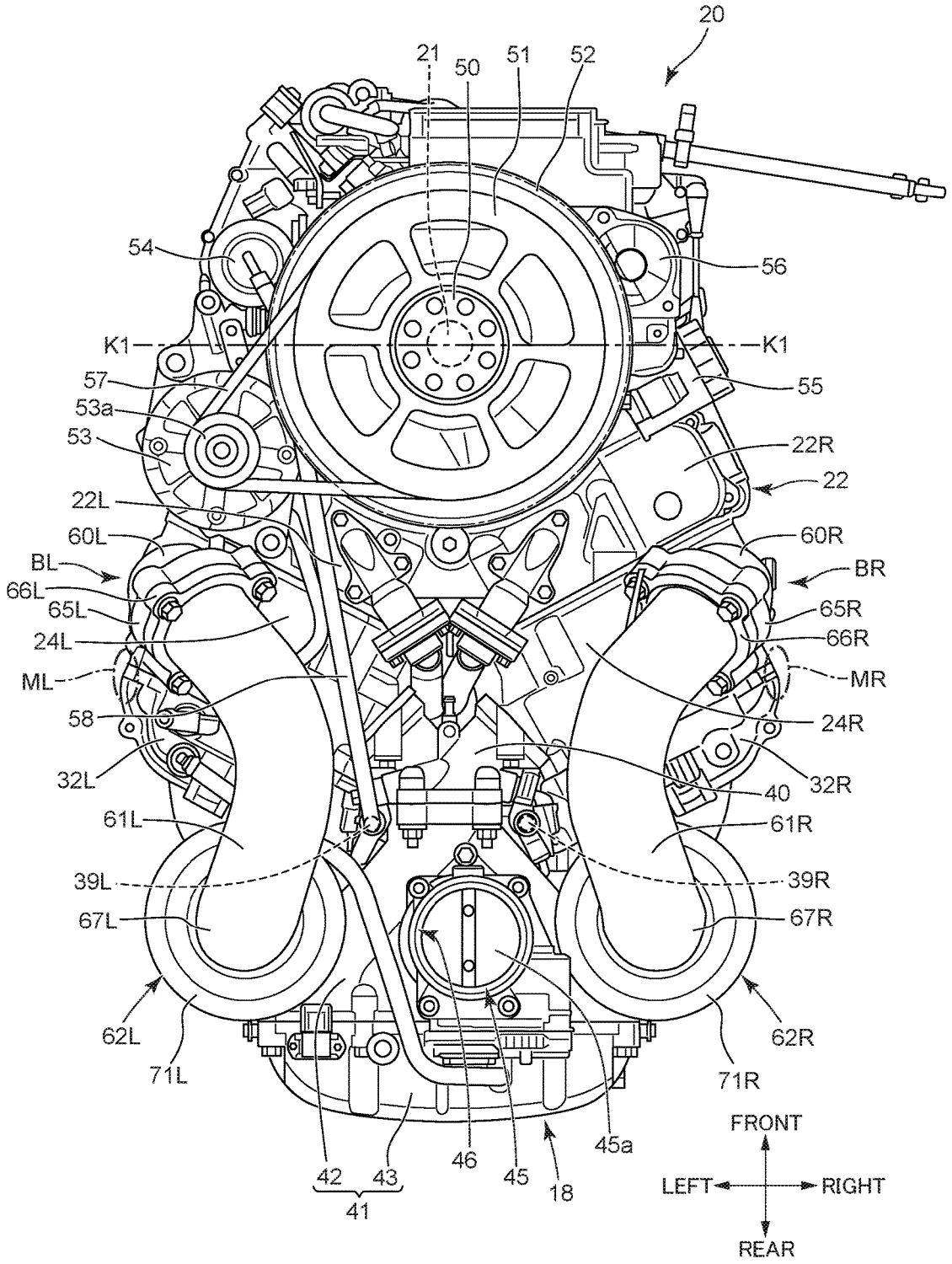
FIG. 4 is a top view showing the internal structure of the outboard motor.

As shown in FIG. 3 to FIG. 6, a flywheel 50 is connected to an upper end of the crankshaft 21. A flywheel pulley 51 and a ring gear 52 are fixed coaxially with the flywheel 50, on the outer side of the flywheel 50. The ring gear 52 has a larger diameter than the flywheel pulley 51. As shown in FIG. 4, an alternator 53, a fuel pump 54, an oil filter 55, a starter motor 56, etc. are disposed around the flywheel pulley 51 and the ring gear 52 (on the lateral sides of the crankshaft 21) as seen in a plan view of the engine 20. The alternator 53 and the fuel pump 54 are disposed forward of the left cylinder head 24L. The oil filter 55 and the starter motor 56 are disposed forward of the right cylinder head 24R.

The alternator 53 is located on the rear left side relative to the crankshaft 21 and a central axis of the flywheel 50. A pulley 53*a* is provided at an upper end of the alternator 53. A transmission belt 57 is wrapped around the flywheel pulley 51 and the pulley 53*a*. When the crankshaft 21 rotates, the flywheel pulley 51 rotates along with the flywheel 50, and this rotational force is transmitted to the pulley 53*a* through the transmission belt 57. The alternator 53 has a built-in permanent magnet and coil, and one of the permanent magnet and the coil is a rotor that rotates along with the pulley 53*a* and the other one is a stator that is fixed. When the pulley 53*a* rotates, an electric current is generated in the coil by electromagnetic induction. Alternating-current power generated in the alternator 53 is converted into a direct current and supplied to the electrical system of the outboard motor 10.

The fuel pump 54 is disposed forward of the alternator 53, and is located on the front left side relative to the crankshaft 21 and the central axis of the flywheel 50. One end of a fuel hose 58 is connected to an upper part of the fuel pump 54. The fuel hose 58 extends rearward from the fuel pump 54 and is connected to an upper end of the delivery pipe 39L (see FIG. 4). More specifically, the fuel pump 54 is located below the flywheel pulley 51 and the ring gear 52, and the fuel hose 58 extending from the fuel pump 54 passes under the flywheel pulley 51, the ring gear 52, and the transmission belt 57 (see FIG. 6), and extends rearward at an angle similar to the angle of the bank central axis RX1 of the right bank BR as seen in a plan view. Then, the fuel hose 58 passes above the left bank part 22L and the cylinder head 24L and reaches a position at the upper end of the delivery pipe 39L.

Fuel stored in a fuel tank (not shown) is delivered to the fuel hose 58 through the fuel pump 54. The delivery pipe 39L and the delivery pipe 39R communicate with each other, and the fuel supplied via the fuel hose 58 flows into both the delivery pipe 39L and the delivery pipe 39R. Then, the fuel having entered the delivery pipe 39L is injected from the injector 38L, and the fuel having entered the delivery pipe 39R is injected from the injector 38R.

Thus, the alternator 53 that is a power generator in the outboard motor 10 and the fuel pump 54 that constitutes part of the fuel supply system are disposed forward of the cylinder head 24L of the engine 20. As shown in FIG. 4, the fuel pump 54 and the alternator 53 are disposed so as to be distributed between the front side and the rear side, respectively, relative to an imaginary line K1 passing through the central axis of the crankshaft 21 and extending in the left-right direction, so that the amounts of protrusion of the alternator 53 and the fuel pump 54 toward the left side are reduced.

In particular, the alternator 53 that has a larger size (larger diameter) than the fuel pump 54 as seen in a plan view is disposed on the side closer to the cylinder head 24L in the front-rear direction, and the fuel pump 54 having a smaller size (smaller diameter) is disposed forward of the alternator 53. Thus, on the left side of the engine 20, the parts are disposed such that the amount of protrusion toward the left side increases stepwise from the front end side (fuel pump 54) toward the rear side (cylinder head 24L). As a result, the alternator 53 and the fuel pump 54 can be efficiently housed on the front side of the cylinder head 24L, without impairing the smoothly curved shape of the left side surface of the engine cover 13 (upper cover 15) shown in FIG. 2.

The oil filter 55 is a filter that removes foreign objects from the oil circulating through a lubricating oil flow passage, and is mounted on a right side portion of the right bank part 22R. As shown in FIG. 2, the oil filter 55 is located on the front right side relative to the cylinders 25 inside the right bank part 22R, and has a cylindrical shape extending in a direction substantially perpendicular to the bank central axis RX1 of the right bank BR.

The starter motor 56 has a pinion that meshes with the ring gear 52. When starting the engine 20, the starter motor 56 is activated to rotate the pinion and thereby drive the crankshaft 21 through the ring gear 52 up to a rotation speed that allows the engine 20 to start. The starter motor 56 is disposed forward of the oil filter 55, and is located on the front right side relative to the crankshaft 21 and the central axis of the flywheel 50.

Thus, the oil filter 55 constituting part of the lubrication system of the engine 20 and the starter motor 56 for starting the engine 20 are disposed forward of the cylinder head 24R of the engine 20. As shown in FIG. 4, the starter motor 56 and most of the oil filter 55 are disposed so as to be distributed between the front side and the rear side, respectively, relative to the imaginary line K1 passing through the central axis of the crankshaft 21 and extending in the left-right direction, so that the amounts of protrusion of the oil filter 55 and the starter motor 56 toward the right side are reduced.

In particular, the oil filter 55 having a longer shape in the left-right direction than the starter motor 56 as seen in a plan view is disposed on the side closer to the cylinder head 24R in the front-rear direction, and the starter motor 56 having a smaller size in the left-right direction is disposed forward of the oil filter 55. Thus, on the right side of the engine 20, the parts are disposed such that the amount of protrusion toward the right side increases stepwise from the front end side (starter motor 56) toward the rear side (cylinder head 24R). As a result, the oil filter 55 and the starter motor 56 can be efficiently housed on the front side of the cylinder head 24R, without impairing the smoothly curved shape of the right side surface of the engine cover 13 (upper cover 15) shown in FIG. 2.

The alternator 53 generates electricity by using rotary motion of the crankshaft 21. The starter motor 56 transmits rotational force to the crankshaft 21 to start the engine 20. It is therefore desirable that both the alternator 53 and the starter motor 56 be disposed in the vicinity of the crankshaft 21 so as to efficiently transmit motive power from and to the crankshaft 21. When the alternator 53 and the starter motor 56 are dispose so as to be distributed between the left side (rear left side) of the crankshaft 21 and the right side (front right side) of the crankshaft 21, respectively, the configuration is excellent in power transmission efficiency with both the alternator 53 and the starter motor 56 close to the crankshaft 21, and the size in the left-right direction can be minimized.

As shown in FIG. 4, the alternator 53 and the oil filter 55 are housed in a region surrounded by the cylinder head 24L and the cylinder head 24R that are wide portions in the left bank BL and the right bank BR, and by circumferences of the disc-shaped flywheel pulley 51 and the ring gear 52. As shown in FIG. 2, the fuel pump 54 and the starter motor 56 are housed on the lateral sides of the crankcase 23 of which the width in the left-right direction decreases toward the front side. Thus, the components of the fuel supply system (fuel pump 54), the electrical system (alternator 53 and starter motor 56), and the lubrication system (oil filter 55) are disposed with good space efficiency in the spaces on both lateral sides of the crankshaft 21 (crank chamber 19), so that an increase in the size (especially an increase in the width in the left-right direction) of the outboard motor 10 can be prevented.

The parts disposed forward of the left and right cylinder heads 24L, 24R, on the lateral sides of the crankshaft 21 are not limited to those described above. For example, other than the fuel pump 54, a fuel filter, a vapor separator, etc. may be disposed as parts of the fuel supply system. An oil cooler as a part of the lubrication system, an actuator for assisting shifting as a part of the electrical system, etc. may be disposed.

In the following, constituent elements of the exhaust system and the arrangement thereof will be described. As the constituent elements of the exhaust system, exhaust manifolds 60 (60L, 60R), upper exhaust pipes 61 (61L, 61R), catalyst devices 62 (62L, 62R), and a lower exhaust pipe 63 are provided.

The exhaust manifolds 60 (60L, 60R) are composed of a left exhaust manifold 60L integrally formed in the cylinder head 24L, and a right exhaust manifold 60R integrally formed in the cylinder head 24R. Both exhaust manifolds 60L, 60R extend in the up-down direction. The exhaust manifold 60L is provided on the left side of the plurality of (three) exhaust ports 31L of the left bank BL, and each exhaust port 31L communicates with the exhaust manifold 60L at a different position in the up-down direction. The exhaust manifold 60R is provided on the right side of the plurality of (three) exhaust ports 31R of the right bank BR, and each exhaust port 31R communicates with the exhaust manifold 60R at a different position in the up-down direction. While this is not shown, the exhaust manifold 60L and the exhaust manifold 60R each have an inner pipe and a peripheral wall surrounding the inner pipe, and exhaust gas discharged from the exhaust ports 31L, 31R flows upward through the insides of the inner pipes of the exhaust manifolds 60L, 60R. A coolant passage (not shown) through which a coolant flows is formed between the inner pipe and the peripheral wall of each of the exhaust manifolds 60L, 60R.

Coupling portions 65 (65L, 65R) are formed at upper ends of the exhaust manifolds 60 (60L, 60R). The coupling portion 65L provided in the left exhaust manifold 60L is located between the widest portion ML of the left bank BL and the alternator 53 as seen in a plan view (see FIG. 4), and is open obliquely rearward toward the upper right side relative to the exhaust manifold 60L (see FIG. 3, FIG. 5, and FIG. 6). The coupling portion 65R provided in the right exhaust manifold 60R is located between the widest portion MR of the right bank BR and the right bank part 22R as seen in a plan view (see FIG. 4), and is open obliquely rearward toward the upper left side relative to the exhaust manifold 60R (see FIG. 3, FIG. 5, and FIG. 6). Thus, the coupling portions 65L, 65R each open toward the inside of the cylinder bank as seen in a plan view.

Figure 8:
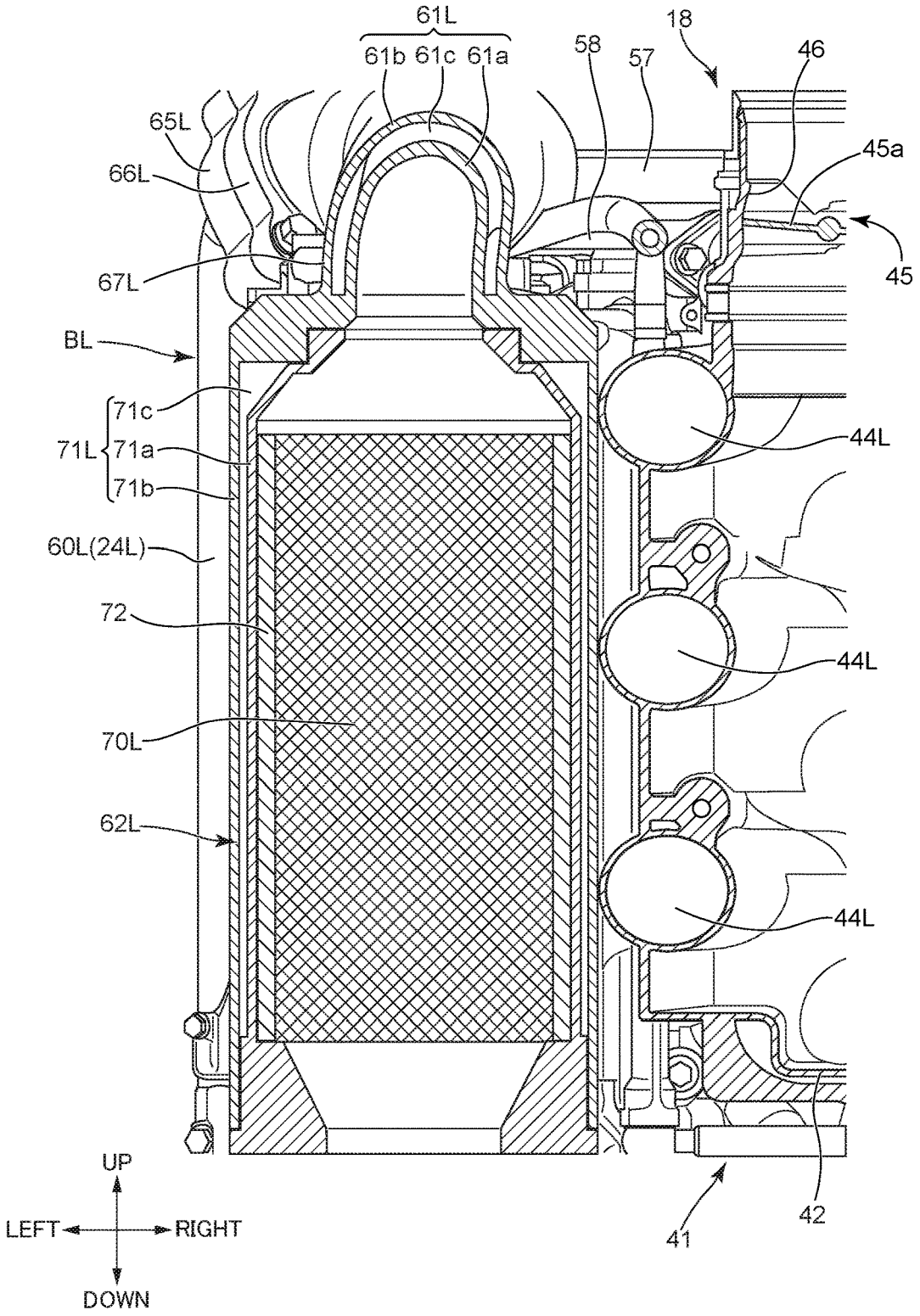
FIG. 8 is a sectional view taken along line VIII-VIII of FIG. 1.

The upper exhaust pipes 61 (61L, 61R) are pipelines that extend toward catalyst connecting portions 67 (67L, 67R) on the rear side, from coupling portions 66 (66L, 66R) connected to the exhaust manifolds 60 (60L, 60R) as base ends. The upper exhaust pipes 61 (61L, 61R) are composed of a left upper exhaust pipe 61L connected to the coupling portion 65L of the exhaust manifold 60L, and a right upper exhaust pipe 61R connected to the coupling portion 65R of the exhaust manifold 60R. As shown in FIG. 5 and FIG. 8, the upper exhaust pipes 61L, 61R each have a double-pipe structure with an inner pipe 61*a* and an outer pipe 61*b* surrounding the inner pipe 61*a*, and a coolant passage 61*c* through which a coolant flows is formed between the inner pipe 61*a* and the outer pipe 61*b*.

The upper exhaust pipe 61L extends rearward by passing above the cylinder head 24L and the head cover 32L in the left bank BL, and the upper exhaust pipe 61R extends rearward by passing above the cylinder head 24R and the head cover 32R in the right bank BR. More specifically, the upper exhaust pipe 61L has a coupling portion 66L that is coupled to the coupling portion 65L by bolt fastening, and extends obliquely from the coupling portion 66L toward the rear right side. The upper exhaust pipe 61L bends at an intermediate point to change its direction, extends obliquely toward the rear left side, and reaches the catalyst connecting portion 67L. On the other hand, the upper exhaust pipe 61R has a coupling portion 66R that is coupled to the coupling portion 65R by bolt fastening, and extends obliquely from the coupling portion 66R toward the rear left side. The upper exhaust pipe 61R bends at an intermediate point to change its direction, extends obliquely toward the rear right side, and reaches the catalyst connecting portion 67R. Thus, the upper exhaust pipe 61L has a curved shape in which a middle part in a long-side direction extends toward the inside of the left bank BL relative to both end portions (coupling portion 66L and catalyst connecting portion 67L) provided apart from each other in the front-rear direction. The upper exhaust pipe 61R has a curved shape in which a middle part in a long-side direction extends toward the inside of the right bank BR relative to both end portions (coupling portion 66R and catalyst connecting portion 67R) provided apart from each other in the front-rear direction. As seen in a plan view, the catalyst connecting portions 67L, 67R are located rearward of the head covers 32L, 32R, respectively.

The catalyst devices 62 (62L, 62R) are composed of a left catalyst device 62L connected to the upper exhaust pipe 61L and a right catalyst device 62R connected to the upper exhaust pipe 61R. The catalyst devices 62L, 62R include catalysts 70 (70L, 70R) and catalyst cases 71 (71L, 71R) housing the catalysts 70 (70L, 70R). The catalyst devices 62L, 62R each have a long shape in an advancing direction of exhaust gas, and are disposed with a long side thereof directed in the up-down direction (vertical direction). FIG. 2 shows central axes of the respective catalyst devices 62L, 62R extending in a long-side direction as catalyst central axes LX2, RX2.

As shown in FIG. 5 and FIG. 8, the catalyst cases 71L, 71R each have a double-cylinder structure with a tubular inner cylinder 71*a* and a tubular outer cylinder 71*b* surrounding the inner cylinder 71*a*, and have a long side thereof directed in the up-down direction (vertical direction). A coolant passage 71*c* through which a coolant flows is formed between the inner cylinder 71*a* and the outer cylinder 71*b*. The catalyst connecting portions 67L, 67R of the upper exhaust pipes 61L, 61R are connected to upper ends of the catalyst cases 71L, 71R, and an inner space of the inner pipe 61*a* and an inner space of the inner cylinder 71*a* communicate with each other to form an exhaust passage. The coolant passage 61*c* and the coolant passage 71*c* communicate with each other. The upper exhaust pipe 61L and the catalyst case 71L are integrally formed, and the upper exhaust pipe 61R and the catalyst case 71R are integrally formed.

The catalysts 70L, 70R are supported inside the inner cylinders 71*a* of the catalyst cases 71L, 71R through catalyst mats 72. Exhaust gas having passed through the upper exhaust pipes 61L, 61R flows downward through the insides of the respective inner cylinders 71*a* of the catalyst cases 71L, 71R, and harmful components in the exhaust gas are removed by the catalysts 70L, 70R.

As shown in FIG. 3, FIG. 5, and FIG. 7, the lower exhaust pipe 63 includes a left passage 75 connected to a lower end of the catalyst case 71L of the catalyst device 62L, a right passage 76 connected to a lower end of the catalyst case 71R of the catalyst device 62R, and a collecting passage 77 into which the left passage 75 and the right passage 76 merge. As shown in FIG. 5, the lower exhaust pipe 63 has a double-pipe structure with an inner pipe 63*a* and an outer pipe 63*b*, and a coolant passage 63*c* through which a coolant flows is formed between the inner pipe 63*a* and the outer pipe 63*b*.

Lower ends of the catalyst cases 71L, 71R are located substantially at the same position as a lower end of the surge tank 41 in the up-down direction, and the lower exhaust pipe 63 is located below the surge tank 41. The left passage 75 extends downward from a portion connected to the lower end of the catalyst case 71L, and bends rightward at an intermediate point to enter a space below the surge tank 41. The right passage 76 extends downward from a portion connected to the lower end of the catalyst case 71R, and bends leftward at an intermediate point to enter the space below the surge tank 41. The left passage 75 and the right passage 76 merge below the surge tank 41, and the collecting passage 77 extends further downward.

As shown in FIG. 7, the lower exhaust pipe 63 is located rearward of the oil pan 48. While this is not shown, an exhaust passage is formed inside the oil pan 48. The collecting passage 77 is coupled to a rear end of the oil pan 48 through a coupling portion 77*a*, and in this coupled state, the exhaust passage inside the oil pan 48 and the collecting passage 77 communicate with each other. The exhaust passage inside the oil pan 48 communicates with an exhaust passage (not shown) that extends downward by passing through the inside of the mid-section 14 and discharges exhaust gas to the outside of the outboard motor 10. The exhaust gas treated by the catalysts 70L, 70R of the catalyst devices 62L, 62R passes through the lower exhaust pipe 63 and this exhaust passage (not shown) and is discharged to the outside of the outboard motor 10 (into the water).

When providing a catalyst device in an outboard motor, it is necessary to make sure that water from the outside that has flowed into the exhaust passage does not come into contact with the high-temperature catalyst. It is therefore preferable to dispose the catalyst device at a position away from an exhaust port through which exhaust gas is discharged to the outside. In the outboard motor 10 of this embodiment, the catalyst devices 62L, 62R are installed inside the engine compartment 13*a* located at an upper part far away from an exhaust port that is provided at a lower part of the mid-section 14, to thereby protect the catalyst devices 62L, 62R against entry of water from the outside.

Generally, the engine compartment housing the engine has the largest dimensions in the long-side direction (front-rear direction) and the width direction (left-right direction) in outboard motors. Therefore, an increase in the dimension of the engine in the width direction leads directly to an increase in the maximum width of the entire outboard motor. Since an increase in the maximum width of the outboard motor affects multi-unit hanging that is a form in which a plurality of outboard motors is used in parallel arrangement, it is desirable to reduce the width of the engine as much as possible. On the other hand, a catalyst device needs to have a large volume to produce a sufficient exhaust gas treatment effect, which makes it difficult to install a catalyst device inside the engine compartment of an outboard motor while avoiding an increase in the size of the engine. Since a catalyst device reaches a high temperature during driving of the engine, providing a catalyst device inside the engine compartment in which various parts are disposed at high density requires preventing the heat effect on the surrounding parts. Moreover, when a catalyst device is provided inside the engine compartment, the exhaust route from the exhaust port of the engine to the catalyst device has a shape that hinders the smooth flow of exhaust gas (a shape with an excessively large bend etc.), which makes it necessary to take into account a possible decrease in the engine output due to pressure loss. The outboard motor 10 of this embodiment has the catalyst devices 62L, 62R disposed inside the engine compartment 13*a* while circumventing these restrictions.

As has been described above, in the outboard motor 10, the constituent elements of the intake device 18 are disposed rearward of the V-shaped cylinder bank including the left bank BL and the right bank BR. More specifically, the intake manifold 40 is disposed between the left bank BL and the right bank BR in the left-right direction, and the surge tank 41 is disposed rearward of the intake manifold 40. The surge tank 41 has a box shape elongated in the up-down direction, and the width of the surge tank 41 in the left-right direction is smallest at a front end portion connected to the intake manifold 40, and this width in the left-right direction increases toward the rear side. The width in the left-right direction becomes largest near the portion at which the surge tank main body 42 and the lid member 43 are coupled together. The maximum width of the surge tank 41 in the left-right direction is smaller than the width across the widest portions ML, MR of the left bank BL and the right bank BR. This means that the intake device 18 including the intake manifold 40 and the surge tank 41 is disposed on the inside of the V-shaped cylinder bank in the left-right direction.

The catalyst devices 62L, 62R are disposed rearward of the cylinder heads 24L, 24R in the front-rear direction, on the lateral sides of the surge tank 41 (more particularly, the surge tank main body 42) in the left-right direction. In other words, the intake device 18 and the catalyst devices 62L, 62R on both sides of the intake device 18 are disposed next to one another rearward of the V-shaped cylinder bank.

Between a rear end portion of the head cover 32L forming a rearmost end of the left bank BL and a left side surface of the surge tank main body 42, there is, as seen in a plan view, a substantially triangular space of which the length in the front-rear direction increases gradually toward the left side, and the catalyst device 62L is housed in this space. Similarly, between a rear end portion of the head cover 32R forming a rearmost end of the right bank BR and a right side surface of the surge tank main body 42, there is, as seen in a plan view, a substantially triangular space of which the length in the front-rear direction increases gradually toward the right side, and the catalyst device 62R is housed in this space. Since the catalyst devices 62L, 62R have the long sides directed in the up-down direction, the catalyst devices 62L, 62R can be housed if there are areas corresponding to horizontal cross-sections of the catalyst cases 71L, 71R as seen in a plan view like FIG. 2 and FIG. 4. The aforementioned substantially triangular spaces meet this condition.

The cylinder heads 24L, 24R and the surge tank 41 have shapes that are long in the up-down direction, corresponding to the left bank BL and the right bank BR having the cylinders arrayed in the up-down direction. Since the long sides of the catalyst devices 62L, 62R extend along length directions of the cylinder heads 24L, 24R and the surge tank 41, the catalyst devices 62L, 62R can be housed without protruding in the up-down direction relative to the other constituent elements of the engine 20 (see FIG. 3, FIG. 7, and FIG. 8).

As shown in FIG. 2 and FIG. 4, the entire catalyst device 62L is located on the right side relative to the widest portion ML of the left bank BL (on the inside of the cylinder bank), and the entire catalyst device 62R is located on the left side relative to the widest portion MR of the right bank BR (on the inside of the cylinder bank). Therefore, the engine 20 does not have the maximum width at the positions of the catalyst devices 62L, 62R, and providing the catalyst devices 62L, 62R does not add to the width dimension of the outboard motor 10. This means that providing the catalyst devices 62L, 62R does not affect multi-unit hanging of the outboard motor 10.

As shown in FIG. 2, most of the catalyst device 62L including the catalyst central axis LX2 is located on the right side relative to the bank central axis LX1 of the left bank BL (on the inside of the cylinder bank), and most of the catalyst device 62R including the catalyst central axis RX2 is located on the left side relative to the bank central axis RX1 of the right bank BR (on the inside of the cylinder bank). Thus, it is not only that the engine 20 does not have the maximum width at the positions of the catalyst devices 62L, 62R, but also that the amounts of protrusion of the catalyst devices 62L, 62R in the width direction of the outboard motor 10 can be reduced. As a result, the outboard motor 10 can have the outer shape (see FIG. 2) in which the width of the outboard motor 10 decreases from the widest portions ML, MR of the left and right cylinder heads 24L, 24R toward the rear side, with the width in the left-right direction across the widest portions ML, MR, that across the left and right catalyst devices 62L, 62R, and that across both side portions of the surge tank 41 decreasing in this order.

As shown in FIG. 2 and FIG. 4, front ends of the catalyst devices 62L, 62R (catalyst cases 71L, 71R) are located close to rear ends of the head covers 32L, 32R. The rear ends of the catalyst devices 62L, 62R (catalyst cases 71L, 71R) are located near a joint interface between the surge tank main body 42 and the lid member 43 in the front-rear direction, and are located forward of a rear end of the surge tank 41 (lid member 43). Accordingly, providing the catalyst devices 62L, 62R does not add to the size of the outboard motor 10 in the front-rear direction either.

As has been described above, the catalyst devices 62L, 62R are disposed by effectively using the spaces rearward of the left and right cylinder heads 24L, 24R in the left bank BL and the right bank BR, on the lateral sides of the intake device 18. Since an increase in the dimension, especially an increase in the size in the width direction, of the outboard motor 10 resulting from housing the catalyst devices 62L, 62R inside the engine compartment 13*a* is avoided, concerns about affecting multi-unit hanging are eliminated.

The arrangement of the catalyst devices 62L, 62R in this embodiment is also excellent in exhaust efficiency. The left bank BL and the right bank BR have the valve gear chambers 33 at rear parts of the cylinder heads 24L, 24R, and the catalyst devices 62L, 62R are located rearward of the cylinder heads 24L, 24R and the head covers 32L, 32R including the valve gear chambers 33. Thus, a long distance from the exhaust ports 31L, 31R to the catalyst devices 62L, 62R in the front-rear direction can be secured. The upper exhaust pipes 61L, 61R pass above the cylinder heads 24L, 24R and the head covers 32L, 32R, and connect the coupling portions 65L, 65R provided at the upper ends of the exhaust manifolds 60L, 60R to the upper ends of the catalyst devices 62L, 62R. Thus, the exhaust route from the exhaust ports 31L, 31R to the catalyst devices 62L, 62R is smooth without an extreme bend or a turn-around at an intermediate point, so that the pressure loss due to resistance to the flow of exhaust gas can be reduced and a decrease in the output of the engine 20 can be prevented.

Moreover, as shown in FIG. 4, the upper exhaust pipes 61L, 61R each have a curved shape so as to enter the inside of the cylinder bank as seen in a plan view (reduce the interval between the upper exhaust pipes 61L, 61R in the left-right direction) between the coupling portions 66L, 66R and the catalyst connecting portions 67L, 67R. This configuration makes it possible to prevent the upper exhaust pipes 61L, 61R from projecting in the left-right direction and contribute to downsizing the outboard motor 10, while securing a length of a flow passage for cooling the exhaust gas between the exhaust manifolds 60L, 60R and the catalyst devices 62L, 62R. Since intermediate portions of the upper exhaust pipes 61L, 61R are gently curved at a bending angle of smaller than 90° as seen in a plan view, these upper exhaust pipes 61L, 61R are unlikely to create such an exhaust resistance as can cause a decrease in the output.

Since each of the pair of left and right upper exhaust pipes 61L, 61R and the pair of left and right catalyst devices 62L, 62R are substantially symmetrical with respect to a centerline of the outboard motor 10 in the width direction, this configuration is unlikely to disturb the weight balance of the outboard motor 10 in the width direction.

As shown in FIG. 3 and FIG. 5, the lengths of the catalyst devices 62L, 62R in the up-down direction are equivalent to those of the cylinder block 22 and the cylinder heads 24L, 24R. As shown in FIG. 2 and FIG. 4, the outside diameters of the catalyst cases 71L, 71R are larger than the horizontal dimensions of the alternator 53, the fuel pump 54, the oil filter 55, and the starter motor 56. Therefore, the catalyst devices 62L, 62R that are large-sized constituent elements cannot be housed forward of the cylinder heads 24L, 24R, at positions corresponding to the alternator 53, the fuel pump 54, the oil filter 55, and the starter motor 56. To dispose the catalyst devices 62L, 62R forward of the cylinder heads 24L, 24R, there is no other choice but to provide the catalyst devices 62L, 62R at such positions as to project farther in the left-right direction than the left bank BL and the right bank BR, which makes the width of the outboard motor 10 larger than the width across the widest portions ML, MR.

Moreover, to dispose the catalyst devices 62L, 62R forward of the cylinder heads 24L, 24R, at positions close to the exhaust manifolds 60L, 60R, an exhaust route having a very large bending angle (e.g., a turn-around at which the route makes an almost 180° turn) at an intermediate point is required, which may cause a decrease in the engine output due to an increase in the exhaust resistance.

As described above, in the outboard motor 10 of this embodiment, accessories such as the alternator 53, the fuel pump 54, the oil filter 55, and the starter motor 56 are disposed forward of the cylinder heads 24L, 24R, on the lateral sides of the crankshaft 21, while the catalyst devices 62L, 62R are disposed rearward of the cylinder heads 24L, 24R, on the lateral sides of the intake device 18. Thus, disadvantages as described above are avoided, and downsizing and an increase in the exhaust efficiency of the outboard motor 10 are achieved.

Moreover, in the outboard motor 10 of this embodiment, heat from the catalyst devices 62L, 62R hardly affects other portions. Specifically, parts of the fuel supply system including the fuel pump 54 are disposed forward of the cylinder heads 24L, 24R, while the catalyst devices 62L, 62R are disposed rearward of the cylinder heads 24L, 24R, so that a long distance between the fuel supply system and the catalyst devices 62L, 62R is secured. Thus, the effect of heat from the catalyst devices 62L, 62R on the fuel supply system can be minimized.

As shown in FIG. 4, the fuel hose 58 extending from the fuel pump 54 is connected to the delivery pipe 39L by passing between the upper exhaust pipes 61L, 61R that are provided apart from each other in the left-right direction, and is therefore hardly affected by heat from the exhaust system.

Moreover, the alternator 53, the oil filter 55, the starter motor 56, etc. other than the fuel pump 54 are also disposed forward of the cylinder heads 24L, 24R at a great distance from the catalyst devices 62L, 62R, and are therefore hardly affected by heat from the catalyst devices 62L, 62R.

The surge tank 41 constituting part of the intake device 18 is located at a position between the left and right catalyst devices 62L, 62R. As shown in FIG. 5 and FIG. 8, the intake pipes 44L, 44R inside the surge tank 41 are located at positions close to outer surfaces of the outer cylinders 71*b* of the catalyst cases 71L, 71R. The catalyst cases 71L, 71R of the catalyst devices 62L, 62R each have a double-cylinder structure, with the coolant passage 71*c* provided on the inner side of the outer cylinder 71*b*. This means that the insides of the inner cylinders 71*a* housing the catalysts 70L, 70R and the intake pipes 44L, 44R through which suctioned air passes are separated from each other by the coolant passages 71*c*. Accordingly, even when the catalyst devices 62L, 62R are disposed on the lateral sides of and next to the intake device 18, the effect of heat from the high-temperature environment inside the inner cylinders 71*a* on the intake device 18 can be reduced.

As the catalyst devices 62L, 62R are disposed in vertical position on the lateral sides of the intake device 18, the coolant flowing upward from a lower part of the engine 20 can be easily supplied to these catalyst devices 62L, 62R and thus high cooling efficiency can be achieved. Being close to the surge tank 41, the coolant passages 71*c* of the catalyst devices 62L, 62R have also a cooling effect on the intake device 18. An outboard motor structurally tends to have a high intake temperature, and cooling the intake system can increase the output. Since the cooling structure provided in the exhaust system including the catalyst devices 62L, 62R thus serves also to cool the intake device 18, a cooling structure for the surge tank 41 can be omitted for simplification of the configuration and a weight reduction.

The positions of the catalyst devices 62L, 62R can be determined through the surge tank 41. For example, the catalyst cases 71L, 71R may be integrally formed with the surge tank main body 42, or the catalyst cases 71L, 71R and the surge tank main body 42 may be formed as separate parts and fixed to one another.

Since the lower exhaust pipe 63 in which flows of exhaust gas having been treated in the left and right catalyst devices 62L, 62R merge is located below the surge tank 41, rearward of the oil pan 48, the lower exhaust pipe 63 can be housed with good space efficiency without adding to the size of the outboard motor 10 in the front-rear direction or the left-right direction.

As has been described above, in the outboard motor 10 of this embodiment, the catalyst devices 62L, 62R are installed on the upper side where they are hardly affected by water flowing in through the exhaust port, and yet an increase in the size around the engine 20 due to the catalyst devices 62L, 62R is avoided and good exhaust efficiency can be achieved. Moreover, the members around the engine 20 are hardly affected by heat from the catalyst devices 62L, 62R.

The present invention is not limited to the above embodiment but can be implemented with various changes made thereto. The size, shape, etc. of the outboard motor in the above embodiment are not limited to those shown in the accompanying drawings, and these specifications can be changed as necessary within such a range that the effects of the present invention are produced. Other changes can be made as necessary to implement the present invention, as long as no departure is made from the scope of the object of the invention.

For example, the exhaust manifolds 60L, 60R are integrally formed with the cylinder heads 24L, 24R in the above embodiment, but it is also possible to integrally form the exhaust manifolds 60L, 60R with the upper exhaust pipes 61L, 61R and then connect the exhaust manifolds 60L, 60R to the cylinder heads 24L, 24R. The upper exhaust pipes 61L, 61R and the catalyst cases 71L, 71R are integrally formed in the above embodiment, but may instead be formed as separate parts and coupled together by bolt fastening etc. The lower exhaust pipe 63 and the catalyst cases 71L, 71R are separate parts in the above embodiment, but may instead be integrally formed. In short, the combination of members composing the exhaust passage can be arbitrarily selected.

In the above embodiment, the upper exhaust pipes 61L, 61R extend obliquely rearward from the coupling portions 66L, 66R. These extension directions of the upper exhaust pipes 61L, 61R can be changed as necessary on condition that the width of the outboard motor 10 does not increase (that the extension directions are toward the inside of the cylinder bank). For example, the upper exhaust pipes 61L, 61R may extend from the coupling portions 66L, 66R toward the exactly lateral side (90° toward the lateral side) in the left-right direction. Specifically, the shape of the left upper exhaust pipe 61L can be set so as to extend from the position of the coupling portion 66L toward the right side in FIG. 4 and then be directed rearward. The shape of the right upper exhaust pipe 61R can be set so as to extend from the position of the coupling portion 66R toward the left side in FIG. 4 and then be directed rearward. If the extension directions of the upper exhaust pipes 61L, 61R include a forward component (protrude farther forward than the coupling portions 66L, 66R), the upper exhaust pipes 61L, 61R will bend at an excessively large angle at an intermediate point to head for the catalyst devices 62L, 62R located on the rear side, and thereby adversely affect the exhaust efficiency. It is therefore preferable that the maximum angle of the extension directions of the upper exhaust pipes 61L, 61R be limited to 90° toward the lateral side.

As has been described above, the outboard motor of the present invention has the advantage of including the built-in catalyst devices and yet having excellent exhaust efficiency and a compact configuration, and is useful especially as an outboard motor that is expected to be used in the form of multi-unit hanging.

REFERENCE SIGNS LIST

10 Outboard motor
13 Engine cover
14 Mid-section
18 Intake device
20 Engine (V-engine)
21 Crankshaft
22 Cylinder block
22L Left bank part
22R Right bank part
23 Crankcase
24L Cylinder head
24R Cylinder head
25 Cylinder
28 Combustion chamber
30L Intake port
30R Intake port
31L Exhaust port
31R Exhaust port
32L Head cover
32R Head cover
40 Intake manifold
41 Surge tank
44L Intake pipe
44R Intake pipe
45 Throttle body
47 Engine holder
48 Oil pan
51 Flywheel pulley
53 Alternator (power generator)
54 Fuel pump
55 Oil filter
56 Starter motor
57 Transmission belt
58 Fuel hose
60L Exhaust manifold
60R Exhaust manifold
61L Upper exhaust pipe
61R Upper exhaust pipe
62L Catalyst device
62R Catalyst device
63 Lower exhaust pipe
70L Catalyst
70R Catalyst
71L Catalyst case
71R Catalyst case
71*c* Coolant passage
BL Left bank
BR Right bank LX1 Bank central axis
LX2 Catalyst central axis
ML Widest portion
MR Widest portion
RX1 Bank central axis
RX2 Catalyst central axis

What is claimed is:

1. An outboard motor comprising a V-engine having a left bank and a right bank extending obliquely toward a rear left side and a rear right side, respectively, relative to a crankshaft extending in a vertical direction, wherein:

an intake device is provided between the left bank and the right bank;

catalyst devices that treat exhaust gas are disposed rearward of a cylinder head of each of the left bank and the right bank;

the catalyst devices are disposed with a long side directed in the vertical direction; and central axes of the catalyst devices are disposed in an inner region between a central axis of the left bank and a central axis of the right bank as seen in a plan view of the V-engine.

2. The outboard motor according to claim 1, wherein the catalyst devices are disposed on respective sides of the intake device in a width direction of the V-engine.

3. The outboard motor according to claim 1, wherein the catalyst devices are located on an inner side in a width direction of the V-engine relative to widest portions of the respective cylinder heads of the left bank and the right bank.

4. The outboard motor according to claim 1, wherein each of the catalyst devices comprises a catalyst case that houses a catalyst of the catalyst device and is integrally formed with a component of the intake device, and a coolant passage is provided inside the catalyst case.

5. The outboard motor according to claim 1, wherein:

a fuel supply system part that supplies fuel to the engine is disposed on a lateral side of the crankshaft as seen in the plan view of the V-engine; and a fuel hose extending from the fuel supply system part passes between a pair of left and right upper exhaust pipes that are connected to upper ends of the respective cylinder heads, extend rearward, and are connected to the catalyst devices.

6. The outboard motor according to claim 5, wherein each of the pair of upper exhaust pipes extends from an end connected to the upper end of its respective cylinder head toward an inner side of the left bank and the right bank in a width direction of the V-engine.

7. The outboard motor according to claim 1, wherein a power generator that generates electricity by rotation of the crankshaft is disposed forward of the cylinder heads, on a lateral side of the crankshaft, as seen in the plan view of the V-engine.

8. The outboard motor according to claim 1, wherein rear ends of the catalyst devices are located forward of a rear end of the intake device.

9. The outboard motor according to claim 1, wherein a lower exhaust pipe that is connected to lower ends of the catalyst devices is provided under the intake device.

* * * * *